US011365020B1

(12) United States Patent
Diallo et al.

(10) Patent No.: US 11,365,020 B1
(45) Date of Patent: Jun. 21, 2022

(54) DEFECT PREVENTION FOR FLEXIBLE CONTAINER SEALING SYSTEMS

(71) Applicant: Amazon Technologies, Inc., Seattle, WA (US)

(72) Inventors: Souleymane Diallo, Seattle, WA (US); Timothy Alan Talda, Renton, WA (US); Steven Todd Johnson, Kirkland, WA (US); Eric K Wyman, Austin, TX (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 270 days.

(21) Appl. No.: 16/834,837

(22) Filed: Mar. 30, 2020

(51) Int. Cl.
*B65B 57/00* (2006.01)
*B65B 5/02* (2006.01)
*B65B 59/00* (2006.01)

(52) U.S. Cl.
CPC ..... *B65B 57/00* (2013.01); *B65B 5/022* (2013.01); *B65B 59/003* (2019.05)

(58) Field of Classification Search
CPC ..... B65B 5/022; B65B 57/00; B65B 59/003; B65B 9/026; B65B 9/06; B65B 9/067; B65B 9/073; B65B 9/08; B65B 9/087; B65B 9/093; B65B 49/02; B65B 49/04
See application file for complete search history.

(56) References Cited

U.S. PATENT DOCUMENTS 2,735,378 A * 2/1956 Vogt ..... B65B 9/06 425/315
3,195,290 A * 7/1965 Thompson ..... B65B 9/093 53/256
3,209,513 A * 10/1965 Cochrane ..... B65B 9/06 53/568
3,339,337 A * 9/1967 Rapp ..... B65B 9/06 53/550
3,417,544 A * 12/1968 Grevich ..... B65B 9/06 53/550
3,466,836 A * 9/1969 Pratt ..... B65B 9/06 53/450
6,739,115 B1 * 5/2004 Malini ..... B65B 11/10 53/210
10,077,128 B2 * 9/2018 Lue ..... B65C 9/28
10,392,199 B2 * 8/2019 Karpala ..... B65G 61/00
2002/0146491 A1 * 10/2002 Stadtmuller ..... B26D 7/32 426/232
2003/0145560 A1 * 8/2003 Melville ..... B65B 59/003 53/504
2006/0130431 A1 * 6/2006 Baggot ..... B65B 63/02 53/529

(Continued)

*Primary Examiner* — Thomas M Wittenschlaeger
(74) *Attorney, Agent, or Firm* — Eversheds Sutherland (US) LLP

(57) ABSTRACT

Systems, methods, and computer-readable media are disclosed for defect prevention for flexible container sealing systems. In one embodiment, an example flexible container sealing system may include a first camera configured to image an item disposed in a flexible container, a laser system configured to detect presence of items, a cutting assembly configured to cut a material that forms the flexible container, a sealing assembly configured to seal one or more ends of the flexible container, and a computer system configured to determine, using the first camera, a height of the item disposed in the flexible container.

20 Claims, 8 Drawing Sheets

(56) References Cited

U.S. PATENT DOCUMENTS

| | | | | |
|---|---|---|---|---|
| 2008/0236108 | A1* | 10/2008 | Parmley | B65B 11/54 53/504 |
| 2008/0295461 | A1* | 12/2008 | Parmley | B65B 57/12 73/1.01 |
| 2010/0264058 | A1* | 10/2010 | Krause | B65D 5/5088 206/745 |
| 2015/0101281 | A1* | 4/2015 | Kudia | B65B 57/18 53/51 |
| 2015/0291298 | A1* | 10/2015 | Potter | B65B 5/00 53/266.1 |
| 2015/0353212 | A1* | 12/2015 | Williamson | B65B 43/52 53/502 |
| 2017/0015455 | A1* | 1/2017 | Baskin | B65B 57/04 |
| 2017/0253354 | A1* | 9/2017 | Colson | B65B 61/007 |
| 2018/0017506 | A1* | 1/2018 | Monti | B65B 5/103 |
| 2018/0312344 | A1* | 11/2018 | Karpala | B65G 57/00 |
| 2019/0375529 | A1* | 12/2019 | Morino | B65B 65/00 |
| 2020/0207500 | A1* | 7/2020 | Kalinowski | B65B 9/06 |

* cited by examiner

DEFECT PREVENTION FOR FLEXIBLE CONTAINER SEALING SYSTEMS

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that manual efforts can be redirected to different tasks. Moreover, certain types of containers in which items may be packed may be susceptible to damage or may otherwise become defective during shipping and handling. Such defects may be undesirable.

Figure 1:
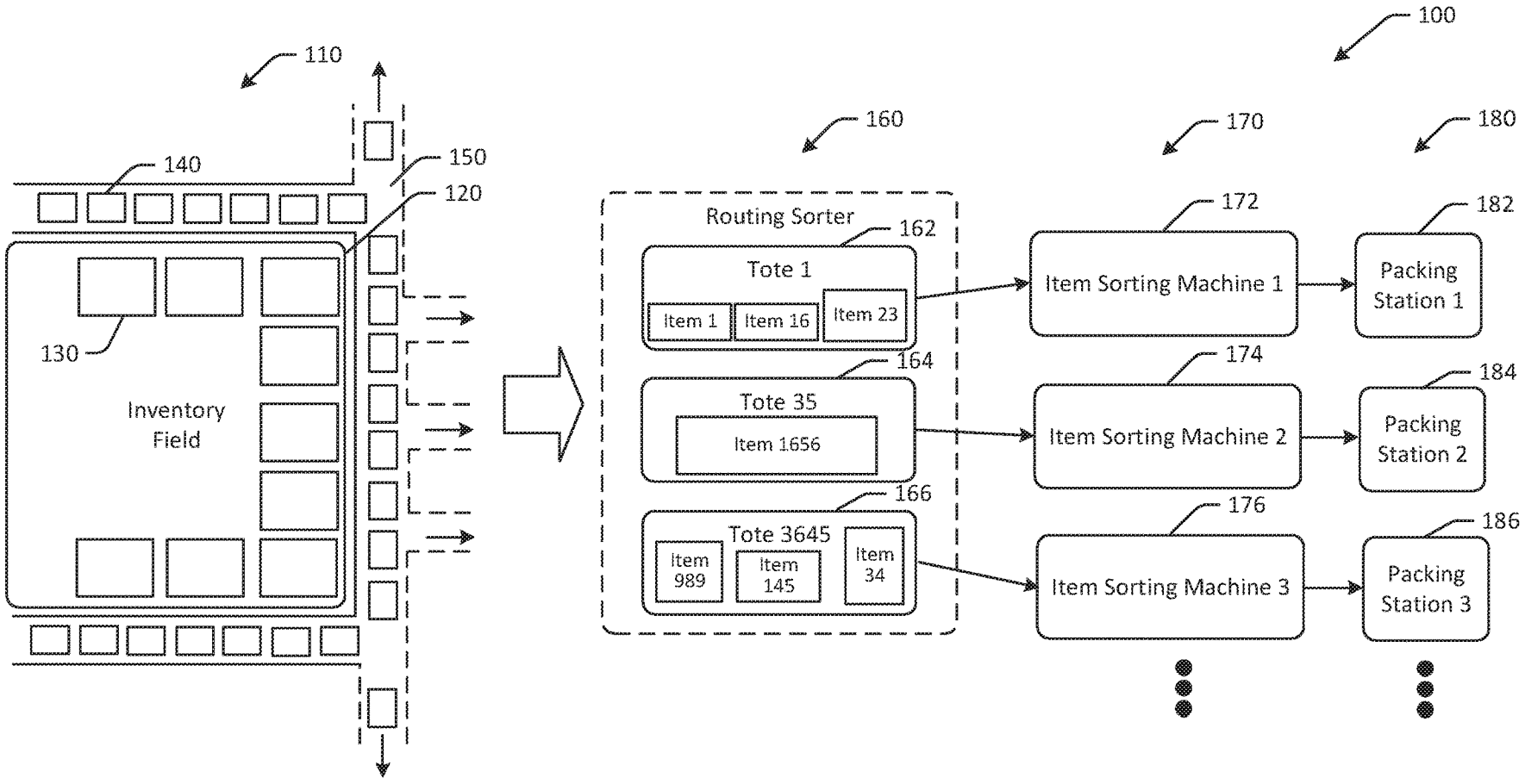
FIG. 1 is a hybrid schematic illustration of an example use case for defect prevention for flexible container sealing systems and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products in an order may be time consuming. In addition, a number of different types of containers may be used to pack items into for shipping. For example, container types may include boxes, bags, flexible containers (e.g., paper mailers, bubble wrap mailers, etc.) and/or other types of containers. Some containers may be susceptible to breakage, damage, or may otherwise become defective during transport and/or handling. Such damage may occur, in some instances, where an item is too large for a flexible container. As damage to packaging or a shipping container may result in damage to an item inside the container, such damage may not be desired.

Embodiments of the disclosure include methods and systems for defect prevention for flexible container sealing systems that may improve packing quality and reduce a risk or a likelihood of a package or container becoming defective during shipping and/or handling. Certain embodiments include camera and/or laser systems that can be used to determine a size of an item to be packed into a flexible container, and may determine whether the item is too large to fit into the flexible container without causing damage or becoming defective. Some embodiments include camera assemblies that can be incorporated into and/or retrofitted into packing equipment or systems. Some embodiments include optimized process flows for processing of orders at fulfillment centers, as well as process flows or methods to increase speed of consolidating products in a single-item or multi-item order as a result of improved speed in placing items into containers and removing items from containers. As a result, throughput of fulfillment centers may be improved, and/or logistics of fulfillment center operations may be less complicated.

In some embodiments, a defect prevention system may be removably coupled to a flexible container sealing system, while in other embodiments, defect prevention systems may be part of an item packing station and/or a flexible container sealing system. Embodiments may be configured to detect potential sealing defects on flexible containers, such as bubble wrap mailers, paper mailers, or other types of flexible containers formed of different types of packaging material, prior to sealing of the flexible container while one or more items are disposed in the container. In some embodiments, only a single item may be packed in a flexible container. Other embodiments may include more than one item. Preventive detection may include detection of items that are too large (e.g., with widths, lengths, or heights that exceed one or more thresholds, etc.), items or packaging of items interfering with vertical sealing of the container (e.g., items positioned too close to a front end of the container prior to sealing, items that may interfere with horizontal sealing and/or cutting, and the like. Embodiments may include laser based vision systems and may include one or more laser smart cameras to cover a range of different item sizes placed inside a container. Some embodiments may also include a smart camera for dual verification of a front seal, along with camera controllers and/or power supplies.

Referring to FIG. 1, an example use case 100 for defect prevention for flexible container sealing systems and an example process flow in accordance with one or more embodiments of the disclosure. Although discussed in the context of online orders, other embodiments may be directed to any suitable use case where objects are packed into containers, such as instances where items for single item orders that are picked from inventory and placed into flexible containers for shipment, and so forth.

In FIG. 1, a fulfillment center may include an inventory field 110, a routing sorter 160, one or more item sorting machines 170, and one or more packing stations 180. The inventory field 110 may be include a storage platform, or a portion of the fulfillment center at which products picked from product inventory are placed. Robots may be used to pick products from inventory and to deliver to the robotic storage platform in some instances, while in other instances, manual labor or a combination thereof may be used to pick products. The picking process at the robotic storage platform may include locating a product in an order, obtaining the product, and sending the product to a robotic storage platform, such as via a conveyor belt. In the illustrated embodiment, products at the robotic storage platform may be placed in a container, such as a tote.

The inventory field 110 may include multiple items that are in inventory. The items may be used to fulfill orders. The inventory field 110 may be a robotic field in some instances. One or more picking stations 130 may be positioned along a perimeter 120 of the inventory field 110. The picking stations 130 may be manually operated or may include robotic components, or a combination thereof. In some instances, picking of items from the inventory field 110 may be completed by robots, where the items are delivered to the picking stations 130 after being retrieved from the inventory field 110. Any number of picking stations 130 may be included, and the picking stations 130 may be located in a different position than that illustrated in FIG. 1.

One or more conveyors 150 may be disposed about the inventory field 110. For example, conveyors 150 may be disposed along the perimeter 120 of the inventory field 110. The conveyors 150 may run adjacent to the picking stations 130 in some embodiments. Any suitable conveyor configuration may be used. In the illustrated example, the conveyors 150 may include belts or rollers that run alongside the picking stations 130 and include one or more paths to one or more routing sorters.

The conveyors 150 may be used to transport one or more totes 140. For example, as totes 140 move along the conveyors 150, items may be moved from the picking stations 130 into respective totes 140. The totes 140 may be associated with particular item sorting machines, and may be moved using the conveyors 150 to a routing sorter 160.

The routing sorter 160 may be configured to route, divert, or otherwise guide certain totes to an item sorting machine. The routing sorter 160 may include any combination of ramps, slides, rollers, arms, guides, and/or other components to route totes to a particular item sorting machine. At the routing sorter 160, totes including products that have been picked may be routed to the appropriate or designated item sorting machine. For example, the routing sorter 160 may determine an identifier associated with the tote, and may determine an item sorting machine associated with the tote using the identifier. The routing sorter 160 may route or direct the tote to the appropriate item sorting machine.

A number of item sorting machines 170 may be coupled to the routing sorter 160. For example, a first item sorting machine 172, a second item sorting machine 174, a third item sorting machine 176, and so forth may be coupled to the routing sorter 160. The routing sorter 160 may guide totes to the item sorting machines to which they are assigned. For example, a first tote 162 may include item 1, item 16, and item 23, and may be assigned to the first item sorting machine 172. The routing sorter 160 may therefore route the first tote 162 to the first item sorting machine 172 for sortation of the respective items. A second tote 164 may include item 1656, and may be assigned to the second item sorting machine 174. The routing sorter 160 may therefore route the second tote 164 to the second item sorting machine 174 for sortation of the item. A third tote 166 may include item 989, item 145, and item 34, and may be assigned to the third item sorting machine 176. The routing sorter 160 may therefore route the third tote 166 to the third item sorting machine 176 for sortation of the respective items.

Some or all of the item sorting machines may be associated with one or more packing stations 180 that may be used to pack items into a shipment when a single-item or multi-item order is complete. For example, the first item sorting machine 172 may be coupled to a first packing station 182, the second item sorting machine 174 may be coupled to a second packing station 184, the third item sorting machine 176 may be coupled to a third packing station 186, and so forth. The item sorting machines may be configured to receive items from totes that have one or more, or multiple, items. The number of totes and/or the number of items associated with respective item sorting machines may be balanced, and multiple totes may be routed to the first item sorting machine 172 and the second item sorting machine 174 at the same time.

Some of the packing stations may be configured to pack items for single-item orders into flexible containers for shipment, such as bubble wrap-based flexible containers or mailers, as single items may not need to be packed into boxes or other relatively rigid containers. In one example embodiments, flexible container sealing systems as described herein may be packing stations for single items orders, such that single items are placed into flexible container envelopes, sealed, and transported downstream for shipment.

At any of the stages of the example fulfillment process of FIG. 1 where handling of objects is used, such as to pick items from inventory, place items in totes, remove items from totes, place items into bins, remove items from bins, place items into boxes for shipping, and so forth, robotic may be used. As a result, manual effort can be redirected to other tasks.

Embodiments of the disclosure include defect prevention for flexible container sealing systems. Certain embodiments may improve shipment quality by preventing defective sealing of flexible containers, and may improve processing speed and/or throughput of fulfillment centers. Certain embodiments may improve performance of mechanical equipment for packing, sortation, and/or consolidation of items. While described in the context of online orders, aspects of this disclosure are more broadly applicable to other forms of object handling.

Example embodiments of the disclosure provide a number of technical features or technical effects. For example, in accordance with example embodiments of the disclosure, certain embodiments of the disclosure may improve packing quality, reduce a likelihood of container defects, improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

Illustrative Embodiments and Use Cases

Figure 2:
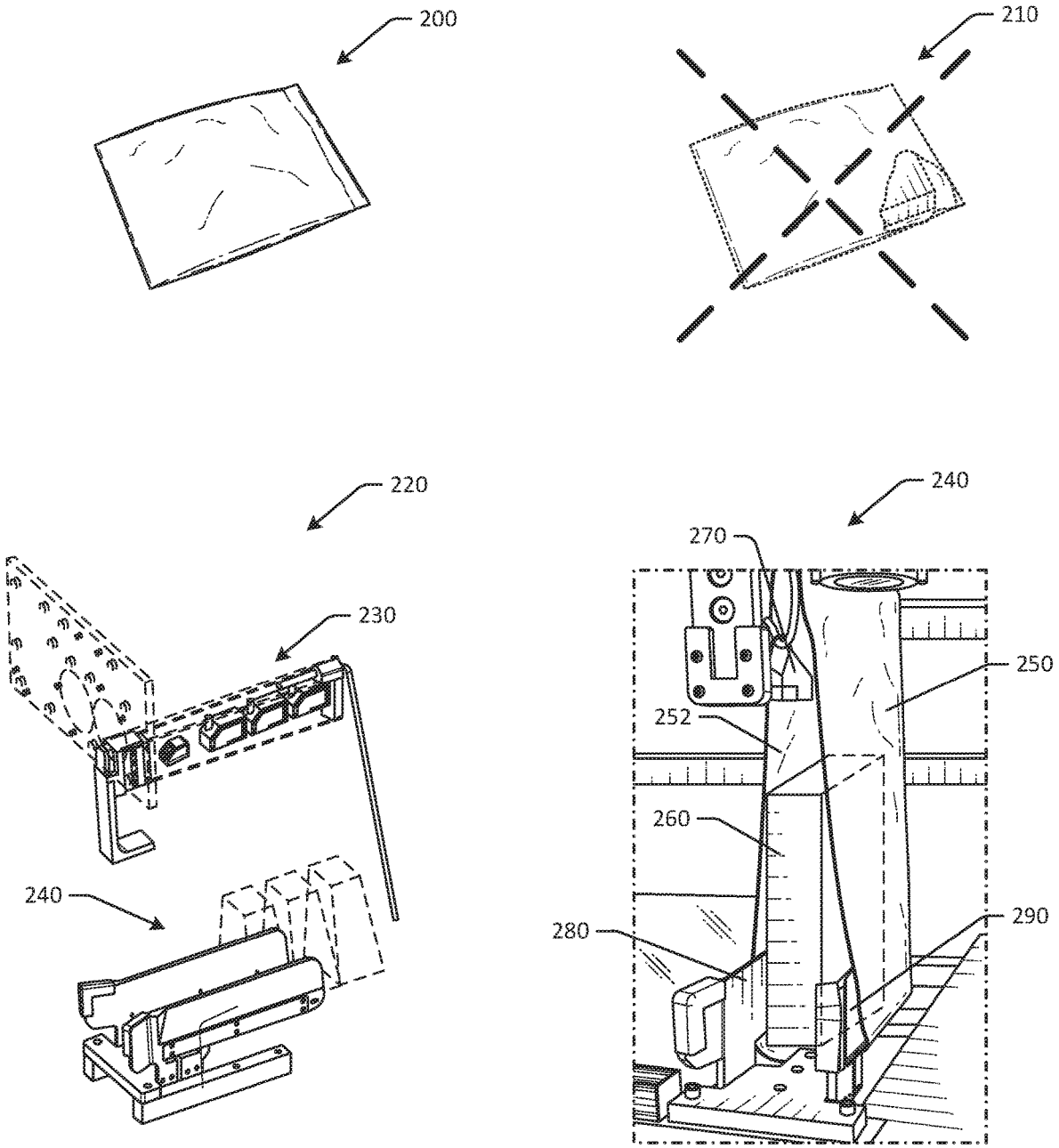
FIG. 2 is a schematic illustration of an example flexible container sealing system in accordance with one or more embodiments of the disclosure.

FIG. 2 is a schematic illustration of an example use case 200 of a flexible container sealing system in accordance with one or more embodiments of the disclosure. Other embodiments may include additional or fewer components. The illustration of FIG. 2 may not be to scale, and may not be illustrated to scale with respect to other figures. The vertical orientation of the container material illustrated in FIG. 2 is for illustrative purposes only, and other embodiments may have a horizontal or other orientation.

In FIG. 2, both a sealed flexible container 200 without defects and a sealed flexible container with defects 210 are illustrated. Defects may occur as a result of stress on the flexible container, which may be formed of bubble wrap, plastic, paper, or other packaging material. Flexible containers may be used to ship one or more items. If the items are too large or are not positioned properly in the flexible container during a sealing process, a likelihood of a defect or damage occurring during shipment may increase. As illustrated in FIG. 2, an example defect is the flexible container bursting open during shipment. Such defects may be undesirable. Embodiments of the disclosure may assist in preventing defects or damage of flexible containers resulting from item size and/or item placement in the flexible container prior to sealing.

An item packing station 220 is depicted in FIG. 2. The item packing station 220 may be a flexible container sealing system and may be configured to pack items into sealed flexible containers. The item packing station 220 may include a set of cameras 230 and a laser system that may be used to image items placed into an envelope of a flexible container prior to sealing of the flexible container, so as to determine a likelihood that the flexible container will be defective when sealed. Because the cameras 230 may image the item before the flexible container is sealed, one or more notifications for remedial measures can be generated. Response actions may be implemented automatically or manually, and then the flexible container may be sealed. As a result, defective sealing and/or defective flexible container formation may be prevented and/or avoided.

To form the flexible container, a material may be guided about an item placement portion 240 of the item packing station 220. The material may be a bubble wrap material or different type of packaging material, such as a plastic or film-based packaging material, and may be a single sheet of material folded in half, where the fold forms a back end or rear end of the flexible container, relative to a front end of the flexible container through which an item 260 may be placed.

As illustrated in a close-up view of the item placement portion 240, two sides of the flexible container to be formed may include a first side 250 and a second side 252. The material that forms the flexible container may be separated by a shroud 270 as the material flows downwards through the item packing station 220. A first vertically oriented guide 280 and a second vertically oriented guide 290 may separate the first side 250 and the second side 252 to define an envelope of the flexible container in which the item 260 can be placed. In some embodiments, the first vertically oriented guide 280 and a second vertically oriented guide 290 may be separated by a fixed distance, so as to limit the width of items that can be placed into the item packing station 220 for packing into a flexible container.

The item packing station 220 may include a flexible material holder, such as a bubble wrap material holder, configured to support a roll of bubble wrap or other flexible material. The bubble wrap may be used to form an envelope in which the item 260 can be placed for shipment. The item packing station 220 may include the shroud 270, which may be configured to separate a first side of the envelope formed by the bubble wrap from a second side of the envelope formed by the bubble wrap, where the first side and the second side are formed by folding the bubble wrap in half. The item packing station 220 may include the first vertically oriented guide 290 configured to guide the first side 250 of the bubble wrap, and a second vertically oriented guide 280 configured to guide the second side 252 of the bubble wrap, where the second vertically oriented guide 280 is separated from the first vertically oriented guide 290 so as to define the envelope. The item 260 can be placed into the envelope between the first vertically oriented guide 290 and the second vertically oriented guide 280. The item packing station 220 may include a cutting and sealing assembly configured to cut the bubble wrap, seal a lower end of the envelope, and seal a front end of the envelope, and as discussed with respect to FIGS. 3-7, the item packing station 220 may include a first camera configured to determine a height of the item 260, and a laser system disposed adjacent to the first camera, the laser system configured to determine whether the item 260 is positioned within a distance of the front end of the envelope. The first camera and the laser system may be disposed within the shroud. The item packing station 220 may include any number of cameras that may be configured to generate data used to determine a length of a perimeter of the item 260.

In an embodiment, the item packing station 220 may include a controller coupled to the laser system and the cameras. The controller may be configured to determine, using the laser system, which the item 260 is not positioned within a distance of the front end of the envelope, and may determine, using the first camera, the length of a perimeter of the item 260. The controller may determine that the length is below a threshold, and may select an envelope length defined between the lower end of the envelope and an upper end of the envelope. The controller may cause the cutting and sealing assembly to form the envelope using the envelope length, where the item 260 is disposed in the envelope when the envelope is sealed.

Figure 3:
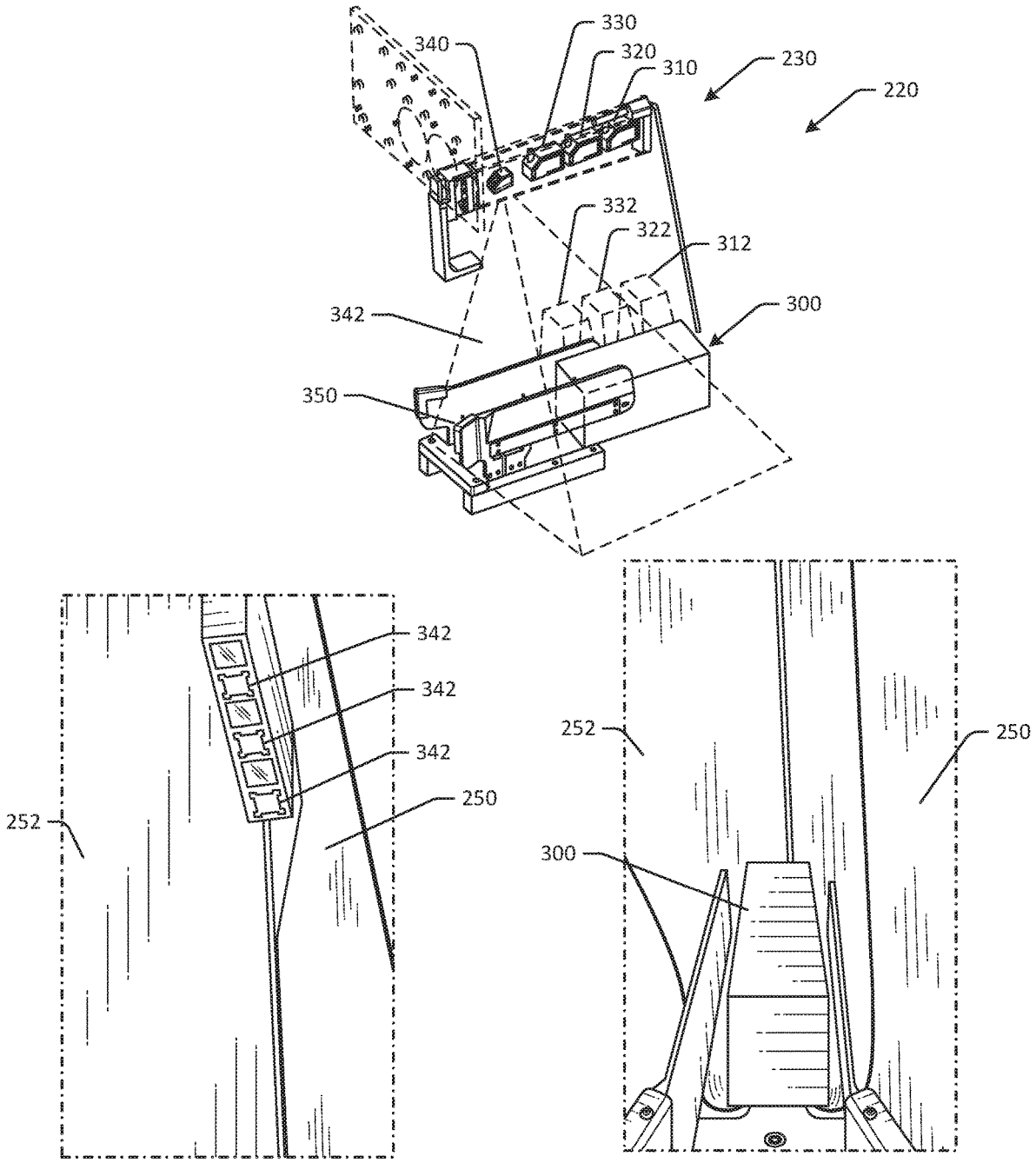
FIG. 3 is a schematic illustration of an example flexible container sealing system in various views in accordance with one or more embodiments of the disclosure.
Figure 4:
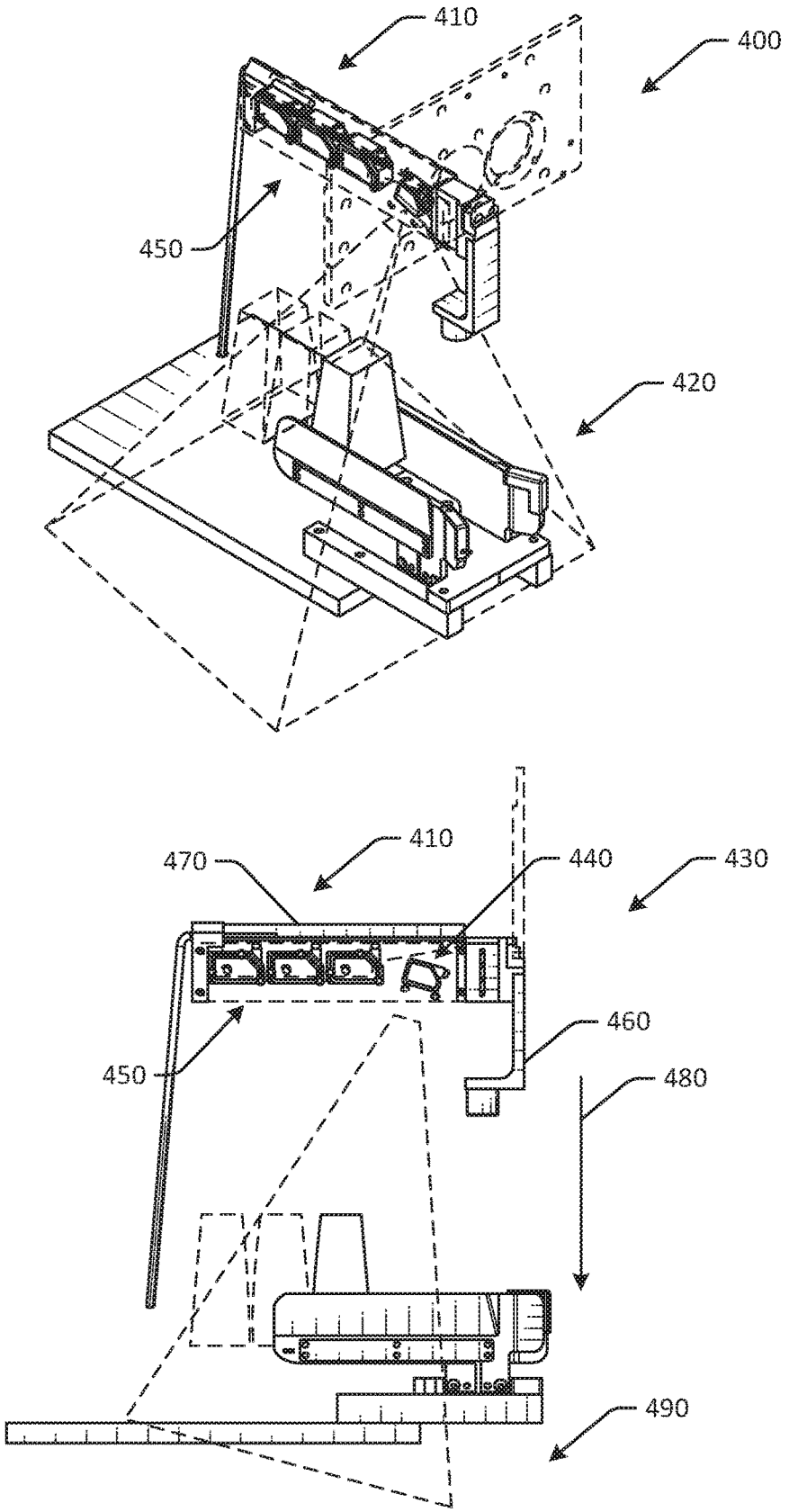
FIG. 4 is a schematic illustration of an example flexible container sealing system in accordance with one or more embodiments of the disclosure.
Figure 5:
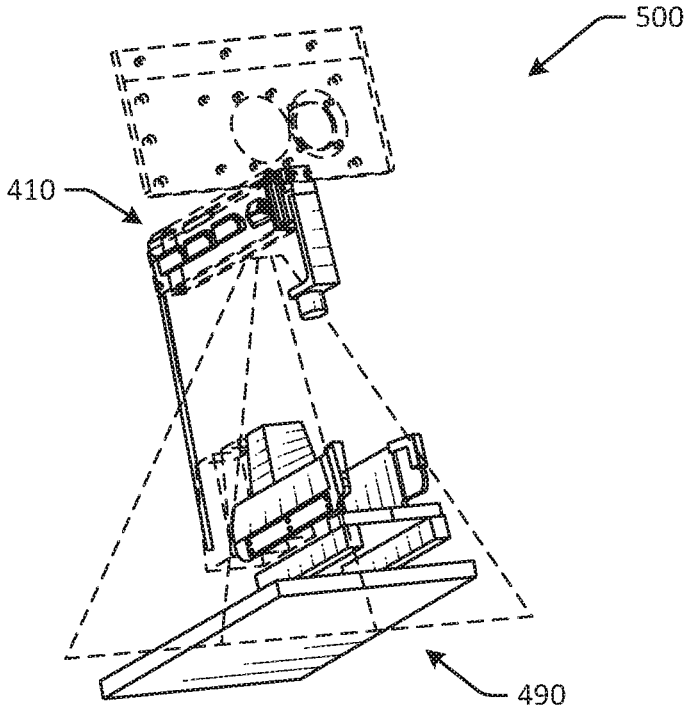
FIG. 5 is a schematic illustration of an example flexible container sealing system in accordance with one or more embodiments of the disclosure.
Figure 5:
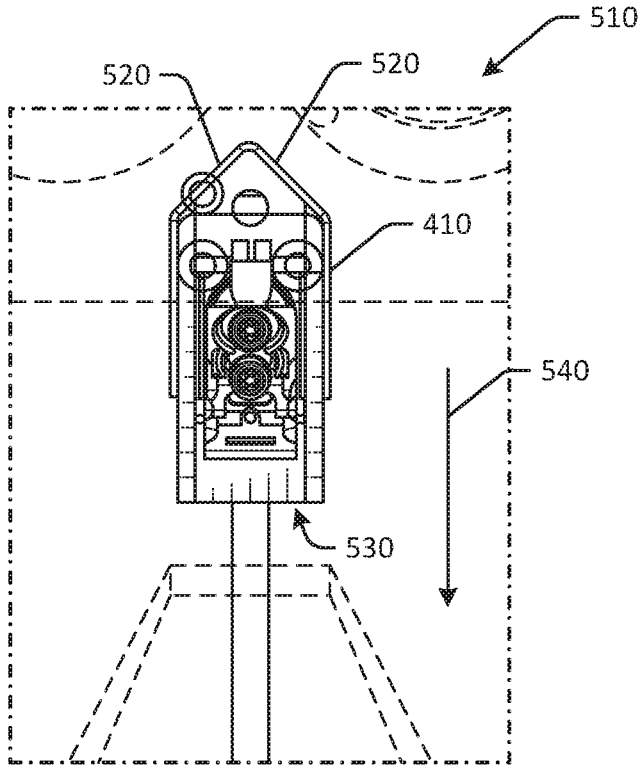

FIGS. 3-5 are schematic illustrations of item packing stations or flexible container sealing systems in various views. Although some components may be discussed using different reference numbers between the drawings, the reference numbers may refer to the same components unless otherwise described.

FIG. 3 is a schematic illustration of an example flexible container sealing system in various views in accordance with one or more embodiments of the disclosure. Other embodiments may include additional or fewer components. The illustration of FIG. 3 may not be to scale, and may not be illustrated to scale with respect to other figures. The vertical orientation of the container material illustrated in FIG. 3 is for illustrative purposes only, and other embodiments may have a horizontal or other orientation. The flexible container sealing system illustrated in FIG. 3 may be the same flexible container sealing systems discussed with respect to FIGS. 1-2.

In FIG. 3, the item packing station 220 is depicted in a perspective view. The item packing station 220 may be a flexible container sealing system and may include the set of cameras 230. For example, the item packing station 220 may include a first camera 310 configured to image an item 300 disposed in a flexible container, a second camera 320 configured to image the item 300, and a third camera 330 configured to image the item 300. The first camera 310 may have first field of view 312, the second camera 320 may have a second field of view 322, and the third camera 330 may have a third field of view 332. The respective fields of view may be used to image the item 300 placed into the flexible container via a front end. Data generated using the respective cameras may be used to determine one or more dimensions of the item 300. Although three cameras are illustrated, any number of cameras may be used in any linear or non-linear arrangement. One or more of the cameras may be a depth sensor or three-dimensional camera, such as a KEYENCE® IX camera. The second camera may be disposed adjacent to the first camera, and a third camera may be disposed adjacent to the second camera. The first camera, the second camera, and the third camera may be configured to generate data used to determine a length of a perimeter of the item.

The item packing station 220 may include a laser system 340 configured to detect presence of items, such as the item 300, within a certain distance of a front end 350 of the flexible container, such as a distance of about 1 inch, about 2 inches, or another distance. The laser system 340 may have a fourth field of view 342 that may be oriented towards the front end 350 of the flexible container. Although one laser system is illustrated, any number of lasers may be used in any linear or non-linear arrangement. One or more of the lasers may be a laser line system, such as a KEYENCE® IV camera. Although described in the context of a laser system, other embodiments may use a camera or other type of sensor instead, such as a smart camera. Accordingly, embodiments may include one or more cameras (and no laser systems). In such embodiments, the camera(s) may be used to determine positioning of an item relative to a front end of the flexible container, as well as to determine one or more dimensions of the item. Such arrangements may result in reduced complexity of the system.

As illustrated in FIG. 3, the cameras may be configured to image an interior portion of the flexible container between the first side 250 and the second side 252 of the flexible container. Lower ends 342 of the cameras may be aligned.

FIG. 4 is a schematic illustration of an example flexible container sealing system 400 in various views in accordance with one or more embodiments of the disclosure. Other embodiments may include additional or fewer components. The illustration of FIG. 4 may not be to scale, and may not be illustrated to scale with respect to other figures. The vertical orientation of the container material illustrated in FIG. 4 is for illustrative purposes only, and other embodiments may have a horizontal or other orientation. The flexible container sealing system illustrated in FIG. 4 may be the same flexible container sealing systems discussed with respect to FIGS. 1-3.

In FIG. 4, the flexible container sealing system 400 may include a shroud assembly 410 disposed on an overhead assembly 470. A number of depth sensors 450 may be disposed adjacent to the shroud assembly 410. A laser system 440 may be disposed at a front end of the shroud assembly 410, as depicted in side view 430. The front end of the shroud assembly may be adjacent to a front end 460 of a flexible container formed by the flexible container sealing system 400. The flexible container sealing system 400 may use a material to form flexible containers where items can be placed into the flexible containers from a front end.

The flexible container sealing system 400 may include vertically oriented guides 420 that separate sides of the flexible material to form an opening into which items can be placed into the flexible container. For example, the flexible container may be formed of a material sheet that is folded in half, where the fold forms a rear end of the flexible container. As the material flows in direction 480, the item and material may pass through to a cutting assembly 490 for sealing of edges of the flexible container, and cutting of the material to release the flexible container from the roll of material. The vertically oriented guides 420 may include a first vertically oriented guide configured to guide the first side of the material that forms the flexible container, and a second vertically oriented guide configured to guide the second side of the material that forms the flexible container. The second vertically oriented guide may be separated from the first vertically oriented guide so as to define an interior of the flexible container. An item can be placed into the interior of the flexible container between the first vertically oriented guide and the second vertically oriented guide. In some embodiments, a distance between the first vertically oriented guide and the second vertically oriented guide may be fixed, whereas in other embodiments, the distance may be adjustable. The material that forms the flexible container may be a bubble wrap material having a first perforation adjacent to a first end, and a second perforation adjacent to a second end, such that when folded, the perforations are aligned with each other and a user can rip open the flexible container using the perforations.

The flexible container sealing system 400 may include the cutting assembly 490 configured to cut a material that forms the flexible container, and a sealing assembly configured to seal one or more ends of the flexible container. In some embodiments, the cutting assembly and the sealing assembly may be integrated, such that sealing occurs while or before cutting occurs, while in other embodiments, discrete cutting and sealing assemblies may be used.

FIG. 5 is a schematic illustration of an example flexible container sealing system in various views in accordance with one or more embodiments of the disclosure. Other embodiments may include additional or fewer components. The illustration of FIG. 5 may not be to scale, and may not be illustrated to scale with respect to other figures. The vertical orientation of the container material illustrated in FIG. 5 is for illustrative purposes only, and other embodiments may have a horizontal or other orientation. The flexible container sealing system illustrated in FIG. 5 may be the same flexible container sealing systems discussed with respect to FIGS. 1-4.

In FIG. 5, the flexible container sealing system 400 is depicted in a bottom perspective view 500 and in a close-up front view 510 of the shroud assembly 410. As depicted in the bottom perspective view 410, the cutting assembly 490 may be disposed at a lower end of the flexible container sealing system 400. The cut and sealed flexible container with the item inside may be dropped onto a conveyor, into a cart, or otherwise transported downstream for further processing, such as application of a shipping label.

In the close-up front view 510, the shroud assembly 410 may include angled surfaces 520 that form a V-shape to assist in separating the material that forms the flexible container as it flows in direction 540. The camera(s) and/or laser system(s) may be disposed within, or may be otherwise coupled to, the shroud assembly 410, such as in an inner portion 530 of the shroud assembly 410.

The flexible container sealing system 400 may therefore be an item packing station that includes a plurality of cameras configured to image an item disposed in a flexible container, where the plurality of cameras and a laser system are disposed adjacent to each other in an interior portion of the flexible container before the flexible container is sealed. The cutting assembly 490 may be configured to cut a material that forms the flexible container, and may include a sealing assembly configured to seal one or more ends of the flexible container.

Figure 6:
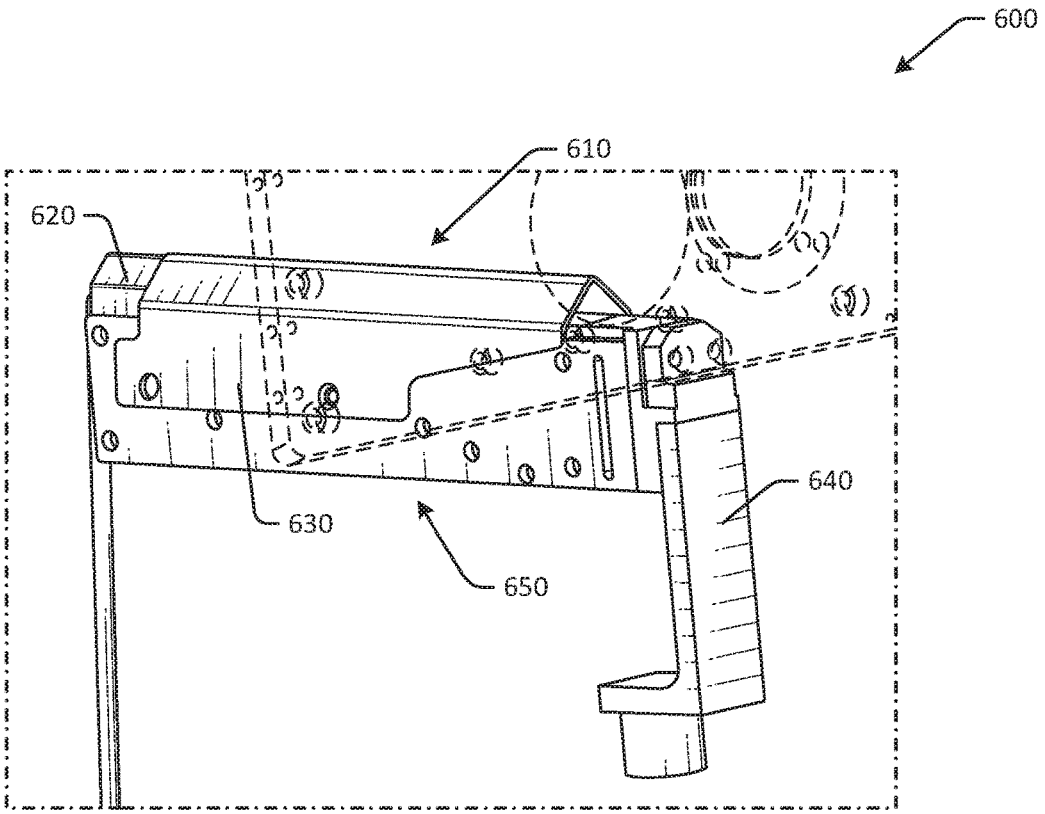
FIG. 6 is a schematic illustration of an example shroud assembly in various views in accordance with one or more embodiments of the disclosure.
Figure 6:
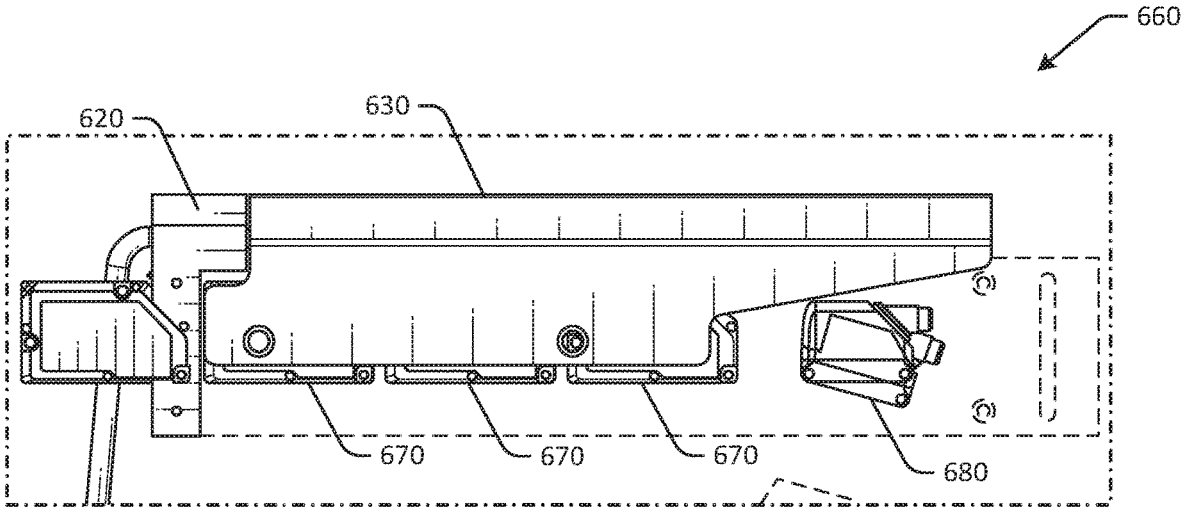

FIG. 6 is a schematic illustration of an example shroud assembly 600 in various views in accordance with one or more embodiments of the disclosure. Other embodiments may include additional or fewer components. The illustration of FIG. 6 may not be to scale, and may not be illustrated to scale with respect to other figures. The shroud assembly illustrated in FIG. 6 may be the same shroud assembly discussed with respect to FIGS. 1-5, and/or may be used with any of the flexible container sealing systems discussed with respect to FIGS. 1-5.

As depicted in FIG. 6, the shroud assembly 600 may be coupled to an overhead assembly 620 of a flexible container sealing system. The shroud assembly 600 may have an inverted V-shaped portion 610 that may separate two sides of the flexible material that forms the flexible container as the material flows "downwards" towards a cutting assembly of the flexible container sealing system. The shroud assembly 600 may include vertical sides 630 coupled to the V-shaped portion 610 to further guide the material and to separate a first side of the flexible container from a second side of the flexible container. The shroud assembly 600 may be coupled to the overhead assembly 620, and in some instances, may be disposed over the overhead assembly 620. A front end 640 of the overhead assembly 620 may be adjacent to a front end of the flexible container formed by the flexible container sealing system. The shroud assembly 600 may include an interior portion 650 disposed between the vertical sides 630. The shroud assembly 600 may therefore be configured to separate a first side of the flexible container from a second side of the flexible container, and may be coupled to an overhead assembly of the flexible container sealing system.

One or more cameras and/or laser systems may be disposed in the interior portion 650 of the shroud assembly 600. For example, as depicted in a side view 660 of the shroud assembly 600 and a portion of the overhead assembly 620, a number of cameras 670 may be coupled to the shroud assembly 600 and disposed in the interior portion 650. The cameras 670 may be depth cameras and/or three-dimensional cameras, and may be disposed in an interior portion or envelope of a pre-sealed flexible container. For example, as the flexible material flows about the vertical sides 630, the cameras 670 may be disposed between a first side of the flexible container to be formed by the material, and a second side of the flexible container to be formed by the material. The cameras 670 may be configured to image items that are placed into an envelope formed by the material. One or more laser systems 680 may be disposed adjacent to the cameras 670 and may be coupled to the shroud assembly 600. The laser system 680 may be disposed at or near the front end 640. The laser system 680 may be configured to detect the presence of an item within a distance of the front end of the flexible container.

Figure 7:
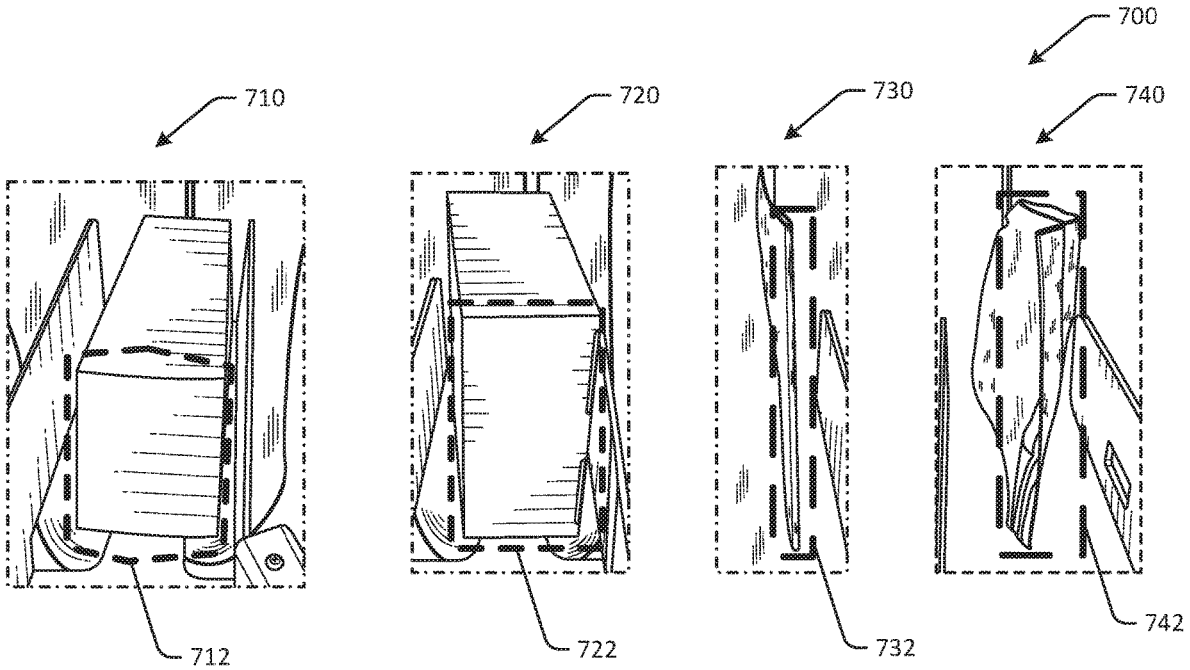
FIG. 7 is a schematic illustration of example perimeter length detection and an example process flow in accordance with one or more embodiments of the disclosure.
Figure 7:
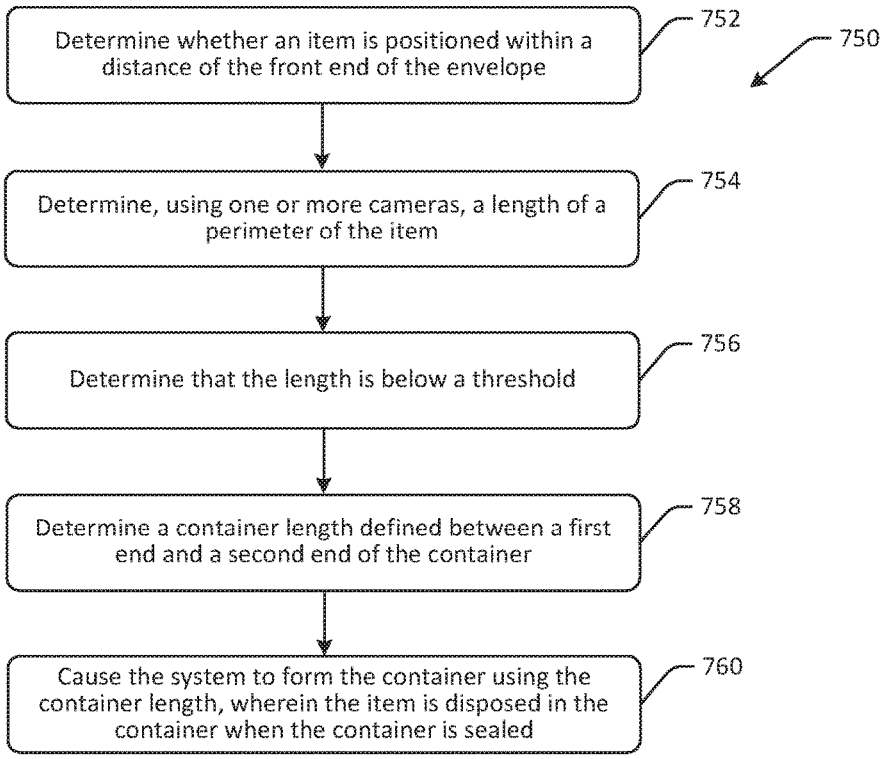

FIG. 7 is a schematic illustration 700 of example perimeter length detection and an example process flow in accordance with one or more embodiments of the disclosure. Other embodiments may include additional or fewer components. The illustration of FIG. 7 is for illustrative purposes only, and an actual perimeter line drawing may not appear or may not necessarily be generated. The operations depicted in the process flow of FIG. 7 may be performed in any order and by any number of computer systems concurrently or at least partially concurrently.

In FIG. 7, a number of example perimeter lengths are depicted for items of various sizes and shapes that are placed into an envelope or the interior portion of a flexible container for sealing and shipment. The perimeter lengths may be determined by one or more controllers or computer systems using data generated from one or more cameras of a flexible container sealing system. In a first example 710, a long rectangular item may be placed into an envelope formed by a flexible material. The long rectangular item may be imaged using one or more depth cameras or three-dimensional cameras. Data generated by the one or more depth cameras may be used to determine a height of the long rectangular object and a width of the long rectangular object. Using the height and the width data, the computer system may determine a length of the perimeter 712 of the long rectangular object, such as by determining a sum of twice the height and twice the length. The length of the perimeter may be compared to a threshold to determine whether the length of the perimeter is equal to or greater than the threshold. If the length of the perimeter is equal to or greater than the threshold, sealing of the flexible container may be prevented, and one or more notifications may be generated. For example, an audio or visual alert may be generated for a manual operator to remove the item from the envelope. If the length of the perimeter is less than the threshold, the envelope may be sealed and another envelope may be formed using the flexible material. Before the envelope is sealed to form the flexible container, a laser system may be used to determine whether the long rectangular item is disposed within a distance of a front end of the flexible container or envelope. If the item is disposed within the distance, a likelihood of sealing defect may be increased. As a result, if the item is disposed within the distance, which may be about one inch, one or more notifications may be generated, such as an audio or visual alert to a manual operator for repositioning of the item in the envelope.

In some embodiments, the threshold may be relative to the height and width of the object, instead of the perimeter length. For example, the computer system may determine the height and the width of the object, and may determine whether or not the combined height and width is equal to or greater than the threshold. Such embodiments may be applicable to items that are rectangular. In other instances, where the item may have an irregular shape, such as items with loose packaging, a length of the perimeter may be determined.

In a second example 720, a tall rectangular item may be placed into an envelope formed by a flexible material. The tall rectangular item may be imaged using one or more depth cameras or three-dimensional cameras. Data generated by the one or more depth cameras may be used to determine a height of the tall rectangular object and a width of the tall rectangular object. Using the height and the width data, the computer system may determine a length of the perimeter 722 of the tall rectangular object, such as by determining a sum of twice the height and twice the length. The length of the perimeter may be compared to a threshold to determine whether the length of the perimeter is equal to or greater than the threshold. If the length of the perimeter is equal to or greater than the threshold, sealing of the flexible container may be prevented, and one or more notifications may be generated. For example, an audio or visual alert may be generated for a manual operator to remove the item from the envelope. If the length of the perimeter is less than the threshold, the envelope may be sealed and another envelope may be formed using the flexible material. Before the envelope is sealed to form the flexible container, a laser system may be used to determine whether the tall rectangular item is disposed within a distance of a front end of the flexible container or envelope. If the item is disposed within the distance, a likelihood of sealing defect may be increased. As a result, if the item is disposed within the distance, which may be about one inch, one or more notifications may be generated, such as an audio or visual alert to a manual operator for repositioning of the item in the envelope.

In a third example 730, a tall thin item may be placed into an envelope formed by a flexible material. The tall thin item may be imaged using one or more depth cameras or three-dimensional cameras. Data generated by the one or more depth cameras may be used to determine a height of the tall thin object and a width of the tall thin object. Using the height and the width data, the computer system may determine a length of the perimeter 732 of the tall thin object, such as by determining a sum of twice the height and twice the length. The length of the perimeter may be compared to a threshold to determine whether the length of the perimeter is equal to or greater than the threshold. If the length of the perimeter is equal to or greater than the threshold, sealing of the flexible container may be prevented, and one or more notifications may be generated. For example, an audio or visual alert may be generated for a manual operator to remove the item from the envelope. If the length of the perimeter is less than the threshold, the envelope may be sealed and another envelope may be formed using the flexible material. Before the envelope is sealed to form the flexible container, a laser system may be used to determine whether the tall thin item is disposed within a distance of a front end of the flexible container or envelope. If the item is disposed within the distance, a likelihood of sealing defect may be increased. As a result, if the item is disposed within the distance, which may be about one inch, one or more notifications may be generated, such as an audio or visual alert to a manual operator for repositioning of the item in the envelope.

In a fourth example 740, an irregularly shaped item may be placed into an envelope formed by a flexible material. The irregularly shaped item may be imaged using one or more depth cameras or three-dimensional cameras. Data generated by the one or more depth cameras may be used to determine a height of the irregularly shaped object and a width of the irregularly shaped object. Using the height and the width data, the computer system may determine a length of the perimeter 742 of the irregularly shaped object, such as by determining a sum of twice the height and twice the length. The length of the perimeter may be compared to a threshold to determine whether the length of the perimeter is equal to or greater than the threshold. If the length of the perimeter is equal to or greater than the threshold, sealing of the flexible container may be prevented, and one or more notifications may be generated. For example, an audio or visual alert may be generated for a manual operator to remove the item from the envelope. If the length of the perimeter is less than the threshold, the envelope may be sealed and another envelope may be formed using the flexible material. Before the envelope is sealed to form the flexible container, a laser system may be used to determine whether the irregularly shaped item is disposed within a distance of a front end of the flexible container or envelope. If the item is disposed within the distance, a likelihood of sealing defect may be increased. As a result, if the item is disposed within the distance, which may be about one inch, one or more notifications may be generated, such as an audio or visual alert to a manual operator for repositioning of the item in the envelope.

A process flow 750 may be used to determine whether an item can be sealed into a flexible container with a low risk of defect. The process flow 750 may be performed by one or more computer systems and/or controllers in communication with a flexible container sealing system.

At block 752, a determination may be made as to whether an item is positioned within a distance of the front end of the envelope, where the envelope is an interior portion of a flexible container. To determine whether the item is positioned within the distance of the front end, data from one or more laser systems may be used. For example, a laser may be used to detect presence of the item within a predetermined distance of the front end. The distance may be, for example, one inch, two inches, or another distance. The laser may be positioned overhead and within the interior portion of the flexible container. If it is determined that the item is positioned within a distance of the front end of the envelope, a notification may be generated and sealing of the flexible container may be prevented until the item is repositioned. If it is determined that the item is not positioned within the distance of the front end of the envelope, the process flow 750 may proceed. In an embodiment, the computer system may determine, using the laser system, presence of the item within a distance of a front end of the flexible container, and may generate a notification indicating that the flexible container may be damaged and/or that the item needs to be repositioned.

At block 754, a length of a perimeter of the item positioned in the envelope may be determined using one or more cameras. For example, data from one or more depth cameras may be used to determine a height and/or width of the item, and a perimeter length may be determined. In some embodiments, one or more of a height, a width, or a length of the item may be determined and compared to one or more thresholds, instead of a length of the perimeter of the item.

At block 756, the computer system may determine that the length of the perimeter is below a threshold. For example, items having a perimeter length of 20 inches or less may be acceptable, whereas items having a perimeter length of greater than 20 inches may not be acceptable. Instead of perimeter length, one or more of height, length, or width may be used and compared to one or more respective thresholds. The threshold may be determined based at least in part on dimensions of flexible containers that can be produced by the flexible container sealing system. For example, if the flexible container sealing system can produce sealed flexible containers having a maximum length of 10 inches, the threshold for perimeter length may be, for example, 15 inches or another threshold.

If the computer system determines a length of a perimeter of the item, and determines that the length is equal to or greater than a threshold, the computer system may generate a notification indicating that the flexible container may be damaged or defective, and may optionally prevent sealing of the flexible container.

At block 758, a container length defined between a first end and a second end of the container may be determined. For example, the flexible container sealing system may be configured to produce more than one size of flexible container depending on a point at which the container material is cut. Sample lengths of flexible containers may be 8 inches, 10 inches, 12 inches, and so forth. In some embodiments, the length of the flexible container may be determined based at least in part on the length of the perimeter of the item to be sealed in the flexible container. For example, the greater the perimeter length, the greater the flexible container length. Accordingly, the computer system may determine the flexible container length using the perimeter length. In some embodiments, the container length may be selected from a set of predetermined length values.

In some embodiments, the computer system may be configured to determine a length of the flexible container based at least in part on the height of the item. For example, the length of the flexible container may be a function of the height of the item as determined when the item is placed into an interior or envelope formed by the flexible container.

At block 760, the computer system may cause the flexible container sealing system and/or item packing station to form the flexible container using the container length, wherein the item is disposed in the container when the container is sealed. For example, the computer system may determine a container length of 10 inches. The computer system may therefore cause the flexible container sealing system to dispense 10 inches of material, and may cause the material to be cut and sealed along any unsealed ends. For example, the unsealed ends may be a front end of the flexible container and a top end of the flexible container (where front and top are relative terms as used herein). Other embodiments may have different unsealed ends. The item may therefore be sealed inside the flexible container.

One or more operations of the methods, process flows, or use cases of FIGS. 1-7 may have been described above as being performed by a user device, or more specifically, by one or more program module(s), applications, or the like executing on a device. It should be appreciated, however, that any of the operations of the methods, process flows, or use cases of FIGS. 1-7 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-7 may be described in the context of the illustrative devices, it should be appreciated that such operations may be implemented in connection with numerous other device configurations.

The operations described and depicted in the illustrative methods, process flows, and use cases of FIGS. 1-7 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-7 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

Figure 8:
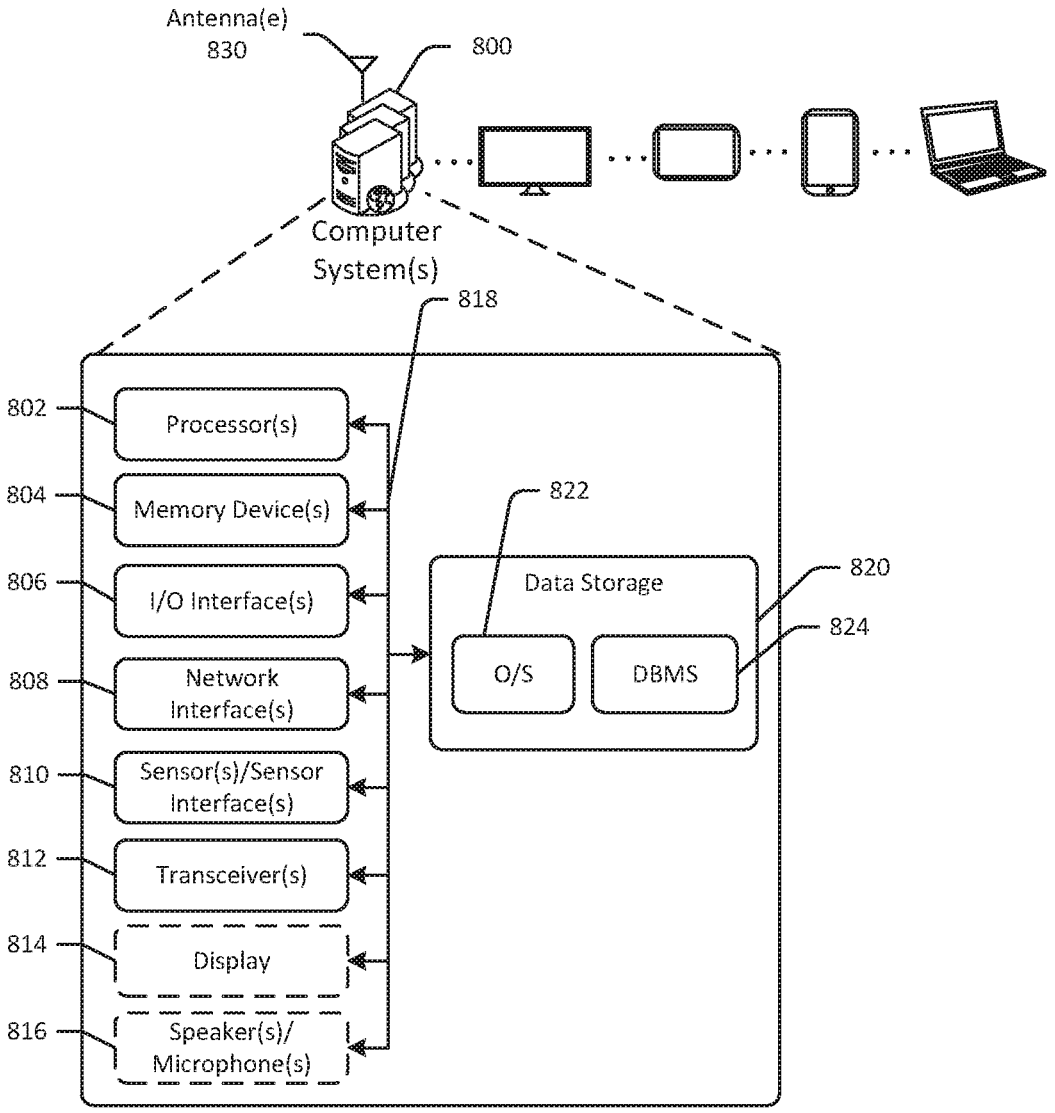
FIG. 8 schematically illustrates an example architecture of a computer system associated with a flexible container sealing system in accordance with one or more embodiments of the disclosure.

FIG. 8 is a schematic block diagram of one or more illustrative computer system(s) 800 in accordance with one or more example embodiments of the disclosure. The computer system(s) 800 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 800 may correspond to an illustrative device configuration for the device(s) of FIGS. 1-7. For example, the computer system(s) 800 may control one or more aspects of the defect prevention for flexible container sealing systems described in FIGS. 1-7.

The computer system(s) 800 may be configured to communicate with one or more servers, user devices, or the like. The computer system(s) 800 may be configured to identify items, detect positioning of items, determine perimeter lengths, and so forth.

The computer system(s) 800 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 800 may include one or more processors (processor(s)) 802, one or more memory devices 804 (also referred to herein as memory 804), one or more input/output (I/O) interface(s) 806, one or more network interface(s) 808, one or more sensor(s) or sensor interface(s) 810, one or more transceiver(s) 812, one or more optional display(s) 814, one or more optional microphone(s) 816, and data storage 820. The computer system(s) 800 may further include one or more bus(es) 818 that functionally couple various components of the computer system(s) 800. The computer system(s) 800 may further include one or more antenna(s) 830 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 818 may include at least one of a system bus, a memory bus, an address bus, or a message bus, and may permit the exchange of information (e.g., data (including computer-executable code), signaling, etc.) between various components of the computer system(s) 800. The bus(es) 818 may include, without limitation, a memory bus or a memory controller, a peripheral bus, an accelerated graphics port, and so forth. The bus(es) 818 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 804 of the computer system(s) 800 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 804 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 804 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 820 may include removable storage and/or non-removable storage including, but not limited to, magnetic storage, optical disk storage, and/or tape storage. The data storage 820 may provide non-volatile storage of computer-executable instructions and other data. The memory 804 and the data storage 820, removable and/or non-removable, are examples of computer-readable storage media (CRSM) as that term is used herein.

The data storage 820 may store computer-executable code, instructions, or the like that may be loadable into the memory 804 and executable by the processor(s) 802 to cause the processor(s) 802 to perform or initiate various operations. The data storage 820 may additionally store data that may be copied to the memory 804 for use by the processor(s) 802 during the execution of the computer-executable instructions. Moreover, output data generated as a result of execution of the computer-executable instructions by the processor(s) 802 may be stored initially in the memory 804, and may ultimately be copied to the data storage 820 for non-volatile storage.

More specifically, the data storage 820 may store one or more operating systems (O/S) 822; one or more database management systems (DBMS) 824; and one or more program module(s), applications, engines, computer-executable code, scripts, or the like. Some or all of these module(s) may be sub-module(s). Any of the components depicted as being stored in the data storage 820 may include any combination of software, firmware, and/or hardware. The software and/or firmware may include computer-executable code, instructions, or the like that may be loaded into the memory 804 for execution by one or more of the processor(s) 802. Any of the components depicted as being stored in the data storage 820 may support functionality described in reference to corresponding components named earlier in this disclosure.

The data storage 820 may further store various types of data utilized by the components of the computer system(s) 800. Any data stored in the data storage 820 may be loaded into the memory 804 for use by the processor(s) 802 in executing computer-executable code. In addition, any data depicted as being stored in the data storage 820 may potentially be stored in one or more datastore(s) and may be accessed via the DBMS 824 and loaded in the memory 804 for use by the processor(s) 802 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 802 may be configured to access the memory 804 and execute the computer-executable instructions loaded therein. For example, the processor(s) 802 may be configured to execute the computer-executable instructions of the various program module(s), applications, engines, or the like of the computer system(s) 800 to cause or facilitate various operations to be performed in accordance with one or more embodiments of the disclosure. The processor(s) 802 may include any suitable processing unit capable of accepting data as input, processing the input data in accordance with stored computer-executable instructions, and generating output data. The processor(s) 802 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 802 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 802 may be capable of supporting any of a variety of instruction sets.

Referring now to other illustrative components depicted as being stored in the data storage 820, the 0/S 822 may be loaded from the data storage 820 into the memory 804 and may provide an interface between other application software executing on the computer system(s) 800 and the hardware resources of the computer system(s) 800. More specifically, the 0/S 822 may include a set of computer-executable instructions for managing the hardware resources of the computer system(s) 800 and for providing common services to other application programs (e.g., managing memory allocation among various application programs). In certain example embodiments, the 0/S 822 may control execution of the other program module(s). The O/S 822 may include any operating system now known or which may be developed in the future including, but not limited to, any server operating system, any mainframe operating system, or any other proprietary or non-proprietary operating system.

The DBMS 824 may be loaded into the memory 804 and may support functionality for accessing, retrieving, storing, and/or manipulating data stored in the memory 804 and/or data stored in the data storage 820. The DBMS 824 may use any of a variety of database models (e.g., relational model, object model, etc.) and may support any of a variety of query languages. The DBMS 824 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 800 is a mobile device, the DBMS 824 may be any suitable lightweight DBMS optimized for performance on a mobile device.

Referring now to other illustrative components of the computer system(s) 800, the input/output (I/O) interface(s) 806 may facilitate the receipt of input information by the computer system(s) 800 from one or more I/O devices as well as the output of information from the computer system(s) 800 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 800 or may be separate. The I/O devices may further include, for example, any number of peripheral devices such as data storage devices, printing devices, and so forth.

The I/O interface(s) 806 may also include an interface for an external peripheral device connection such as universal serial bus (USB), FireWire, Thunderbolt, Ethernet port or other connection protocol that may connect to one or more networks. The I/O interface(s) 806 may also include a connection to one or more of the antenna(s) 830 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, a ZigBee network, etc.

The computer system(s) 800 may further include one or more network interface(s) 808 via which the computer system(s) 800 may communicate with any of a variety of other systems, platforms, networks, devices, and so forth. The network interface(s) 808 may enable communication, for example, with one or more wireless routers, one or more host servers, one or more web servers, and the like via one or more networks.

The antenna(s) 830 may include any suitable type of antenna depending, for example, on the communications protocols used to transmit or receive signals via the antenna(s) 830. Non-limiting examples of suitable antennas may include directional antennas, non-directional antennas, dipole antennas, folded dipole antennas, patch antennas, multiple-input multiple-output (MIMO) antennas, or the like. The antenna(s) 830 may be communicatively coupled to one or more transceivers 812 or radio components to which or from which signals may be transmitted or received.

As previously described, the antenna(s) 830 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 830 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(s) 830 may be configured to transmit or receive radio frequency signals within any suitable frequency range forming part of the unlicensed portion of the radio spectrum.

The antenna(s) 830 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 812 may include any suitable radio component(s) for—in cooperation with the antenna(s) 830—transmitting or receiving radio frequency (RF) signals in the bandwidth and/or channels corresponding to the communications protocols utilized by the computer system(s) 800 to communicate with other devices. The transceiver(s) 812 may include hardware, software, and/or firmware for modulating, transmitting, or receiving—potentially in cooperation with any of antenna(s) 830—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 812 may further include hardware, firmware, or software for receiving GNSS signals. The transceiver(s) 812 may include any known receiver and baseband suitable for communicating via the communications protocols utilized by the computer system(s) 800. The transceiver(s) 812 may further include a low noise amplifier (LNA), additional signal amplifiers, an analog-to-digital (A/D) converter, one or more buffers, a digital baseband, or the like.

The sensor(s)/sensor interface(s) 810 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 814 may be configured to output light and/or render content. The optional speaker(s)/microphone(s) 816 may be any device configured to receive analog sound input or voice data.

It should be appreciated that the program module(s), applications, computer-executable instructions, code, or the like depicted in FIG. 8 as being stored in the data storage 820 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 800, and/or hosted on other computing device(s) accessible via one or more networks, may be provided to support functionality provided by the program module(s), applications, or computer-executable code depicted in FIG. 8 and/or additional or alternate functionality. Further, functionality may be modularized differently such that processing described as being supported collectively by the collection of program module(s) depicted in FIG. 8 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 8 may be implemented, at least partially, in hardware and/or firmware across any number of devices.

It should further be appreciated that the computer system(s) 800 may include alternate and/or additional hardware, software, or firmware components beyond those described or depicted without departing from the scope of the disclosure. More particularly, it should be appreciated that software, firmware, or hardware components depicted as forming part of the computer system(s) 800 are merely illustrative and that some components may not be present or additional components may be provided in various embodiments. While various illustrative program module(s) have been depicted and described as software module(s) stored in the data storage 820, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

One or more operations of the methods, process flows, and use cases of FIGS. 1-7 may be performed by a device having the illustrative configuration depicted in FIG. 8, or more specifically, by one or more engines, program module(s), applications, or the like executable on such a device. It should be appreciated, however, that such operations may be implemented in connection with numerous other device configurations.

The operations described and depicted in the illustrative methods and process flows of any of FIGS. 1-7 may be carried out or performed in any suitable order as desired in various example embodiments of the disclosure. Additionally, in certain example embodiments, at least a portion of the operations may be carried out in parallel. Furthermore, in certain example embodiments, less, more, or different operations than those depicted in FIGS. 1-7 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/ or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. An item packing station comprising:

a packaging material holder configured to support a roll of packaging material, wherein the packaging material is used to form an envelope in which an item can be placed for shipment;

a shroud configured to separate a first side of the envelope formed by the packaging material from a second side of the envelope formed by the packaging material, wherein the first side and the second side are formed by folding the packaging material in half;

a first vertically oriented guide disposed configured to guide the first side of the packaging material;

a second vertically oriented guide disposed configured to guide the second side of the packaging material, wherein the second vertically oriented guide is separated from the first vertically oriented guide so as to define the envelope, wherein the item can be placed into the envelope between the first vertically oriented guide and the second vertically oriented guide;

a cutting and sealing assembly configured to cut the packaging material, seal a lower end of the envelope, and seal a front end of the envelope;

a first camera configured to determine a height of the item; and a laser system disposed adjacent to the first camera, the laser system configured to determine whether the item is positioned within a distance of the front end of the envelope.

2. The item packing station of claim 1, wherein the first camera and the laser system are disposed within the shroud.

3. The item packing station of claim 1, further comprising:

a second camera disposed adjacent to the first camera; and a third camera disposed adjacent to the second camera;

wherein the first camera, the second camera, and the third camera are configured to generate data used to determine a length of a perimeter of the item.

4. The item packing station of claim 3, further comprising:

a controller coupled to the laser system, the first camera, the second camera, and the third camera, the controller configured to:

determine, using the laser system, that the item is not positioned within a distance of the front end of the envelope;

determine, using the first camera, the second camera, and the third camera, the length of a perimeter of the item;

determine that the length is below a threshold;

select an envelope length defined between the lower end of the envelope and an upper end of the envelope; and cause the cutting and sealing assembly to form the envelope using the envelope length, wherein the item is disposed in the envelope when the envelope is sealed.

5. A flexible container sealing system comprising:

a first camera configured to image an item disposed in a flexible container;

a laser system configured to detect presence of items;

a cutting assembly configured to cut a material that forms the flexible container;

a sealing assembly configured to seal one or more ends of the flexible container; and a computer system configured to:

determine, using the first camera, a height of the item disposed in the flexible container.

6. The flexible container sealing system of claim 5, further comprising:

a shroud configured to separate a first side of the flexible container from a second side of the flexible container;

wherein the first camera and the laser system are coupled to the shroud.

7. The flexible container sealing system of claim 6, wherein the shroud is coupled to an overhead assembly of the flexible container sealing system.

8. The flexible container sealing system of claim 6, further comprising:

a first vertically oriented guide disposed configured to guide the first side of the material; and a second vertically oriented guide disposed configured to guide the second side of the material, wherein the second vertically oriented guide is separated from the first vertically oriented guide so as to define an interior of the flexible container;

wherein the item can be placed into the interior of the flexible container between the first vertically oriented guide and the second vertically oriented guide.

9. The flexible container sealing system of claim 8, wherein a distance between the first vertically oriented guide and the second vertically oriented guide is fixed.

10. The flexible container sealing system of claim 5, wherein the computer system is further configured to:

determine a length of a perimeter of the item;

determine that the length is equal to or greater than a threshold; and generate a notification related to the determination that the length is equal.

11. The flexible container sealing system of claim 5, wherein the computer system is further configured to:

determine, using the laser system, presence of the item within a distance of a front end of the flexible container; and generate a notification indicating that the flexible container may be damaged and/or that the item needs to be repositioned.

12. The flexible container sealing system of claim 5, wherein the computer system is further configured to:

determine a length of the flexible container based at least in part on the height of the item.

13. The flexible container sealing system of claim 5, further comprising:

a second camera disposed adjacent to the first camera; and a third camera disposed adjacent to the second camera;

wherein the first camera, the second camera, and the third camera are configured to generate data used to determine a length of a perimeter of the item.

14. The flexible container sealing system of claim 5, wherein the material that forms the flexible container is folded in half to form a rear end of the flexible container.

15. The flexible container sealing system of claim 5, wherein the material that forms the flexible container is a paper-based or plastic-based packaging material comprising a first perforation adjacent to a first end, and a second perforation adjacent to a second end.

16. An item packing station comprising:

a plurality of cameras configured to image an item disposed in a flexible container;

a cutting assembly configured to cut a material that forms the flexible container;

a sealing assembly configured to seal one or more ends of the flexible container; and a computer system configured to:

determine, using the plurality of cameras, a height of the item disposed in the flexible container.

17. The item packing station of claim 16, further comprising:

a laser system configured to detect presence of items;

wherein the computer system is further configured to determine whether the item is within a distance of a front end of the flexible container using the laser system.

18. The item packing station of claim 17, wherein the plurality of cameras and the laser system are disposed adjacent to each other in an interior portion of the flexible container before the flexible container is sealed.

19. The item packing station of claim 16, wherein the computer system is further configured to:

determine a length of a perimeter of the item;

determine that the length is equal to or greater than a threshold; and generate a notification indicating that the flexible container may be damaged.

20. The item packing station of claim 16, wherein the material that forms the flexible container is folded in half to form an end of the flexible container.

* * * * *